US009000987B2

(12) United States Patent
Yu-Jiun et al.

(10) Patent No.: US 9,000,987 B2
(45) Date of Patent: Apr. 7, 2015

(54) COMPACT MULTI-BAND ANTENNA FOR WORLDWIDE MOBILE HANDSET APPLICATIONS

(75) Inventors: Ren Yu-Jiun, Coppell, TX (US); Seong Heon Jeong, Decatur, GA (US); James Paul Warden, Ft. Worth, TX (US); Philip Mac Walker, Keller, TX (US)

(73) Assignee: BlackBerry Limited, Waterloo, Ontario (CA)

( * ) Notice: Subject to any disclaimer, the term of this patent is extended or adjusted under 35 U.S.C. 154(b) by 216 days.

(21) Appl. No.: 13/475,386

(22) Filed: May 18, 2012

(65) Prior Publication Data

US 2013/0307751 A1 Nov. 21, 2013

(51) Int. Cl.

| | |
|---|---|
| ***H01Q 1/24*** | (2006.01) |
| ***H01Q 1/38*** | (2006.01) |
| ***H01Q 1/52*** | (2006.01) |
| ***H01Q 9/42*** | (2006.01) |
| ***H01Q 21/28*** | (2006.01) |

(52) U.S. Cl.

CPC ..... *H01Q 1/243* (2013.01); *H01Q 1/38* (2013.01); *H01Q 1/521* (2013.01); *H01Q 5/371* (2013.01); *H01Q 9/42* (2013.01); *H01Q 21/28* (2013.01)

(58) Field of Classification Search

CPC ..... H01Q 1/243; H01Q 1/521; H01Q 1/38; H01Q 5/0028; H01Q 21/28

USPC ..... 343/702, 893, 700 MS

See application file for complete search history.

(56) References Cited

U.S. PATENT DOCUMENTS

| | | | | |
|---|---|---|---|---|
| 7,450,076 | B1 * | 11/2008 | Lin et al. | 343/702 |
| 7,466,277 | B2 * | 12/2008 | Ishizuka et al. | 343/702 |
| 7,535,422 | B2 * | 5/2009 | Liu et al. | 343/702 |
| 7,733,276 | B2 * | 6/2010 | Levy et al. | 343/702 |
| 7,893,877 | B2 * | 2/2011 | Wang et al. | 343/700 MS |

(Continued)

FOREIGN PATENT DOCUMENTS

| | | |
|---|---|---|
| CN | 101292396 A | 10/2008 |
| CN | 101573831 A | 11/2009 |

(Continued)

OTHER PUBLICATIONS

European Extended Search Report; Application No. 13168271.8; Sep. 9, 2013; 7 pages.

Chinese Office Action as Received in Co-pending Application No. 201310187334.X on Jan. 4, 2015; 15 pages. (No English translation available).

*Primary Examiner* — Hoang V Nguyen

(74) *Attorney, Agent, or Firm* — Conley Rose, P.C.; J. Robert Brown, Jr.

(57) ABSTRACT

A multi-band antenna component is provided. The multi-band antenna component comprises a carrier, a first antenna array, and a second antenna array. The carrier is composed of a ceramic material characterized by a permittivity of at least about 6, said carrier having a first region and a second region distinct from the first region. The first antenna array is disposed on the first region and comprises one or more antennas selected from the group consisting of a first antenna adapted for about 2.4 GHz wireless communication, a second antenna adapted for about 5 GHz wireless communication, and a third antenna adapted for wireless communication for a global positioning system. The second antenna array is disposed on the second region and comprises at least one of a fourth antenna adapted for about 850 MHz wireless communication or a fifth antenna adapted for about 1800/1900 MHz wireless communication.

35 Claims, 7 Drawing Sheets

(56) References Cited

U.S. PATENT DOCUMENTS

| | | | | |
|---|---|---|---|---|
| 7,999,758 | B2 * | 8/2011 | Bae et al. | 343/895 |
| 8,159,399 | B2 * | 4/2012 | Dorsey et al. | 343/702 |
| 2004/0137950 | A1 | 7/2004 | Bolin et al. | |
| 2008/0180343 | A1 | 7/2008 | Lin | |
| 2009/0303140 | A1 | 12/2009 | Sato et al. | |
| 2010/0271272 | A1 | 10/2010 | Sung et al. | |
| 2010/0321274 | A1 * | 12/2010 | Wu | 343/893 |
| 2013/0076580 | A1 * | 3/2013 | Zhang et al. | 343/720 |

FOREIGN PATENT DOCUMENTS

| | | | |
|---|---|---|---|
| EP | 1939984 | A1 | 7/2008 |
| EP | 2104178 | A1 | 9/2009 |
| TW | 200717918 | A | 5/2007 |
| WO | 02078123 | A1 | 10/2002 |

* cited by examiner

COMPACT MULTI-BAND ANTENNA FOR WORLDWIDE MOBILE HANDSET APPLICATIONS

BACKGROUND

Technologies that may be used in wireless communications may include, among others, Global System for Mobile Communications (GSM), IEEE 802.11a/b/g/n, also known as wireless local area network or WLAN, metropolitan area communication systems, and short-range communication systems. Each such technology may operate in a specified frequency range. In addition, devices that use such technologies may also be equipped with a global positioning system (GPS) that also uses a specified frequency band. More specifically, GSM uses frequencies of approximately 850, 1800, and 1900 megahertz (MHz), which will be referred to herein as the GSM 850, GSM 1800, and GSM 1900 bands, respectively. The GSM 1800 and GSM 1900 bands may be referred to collectively as the GSM 1800/1900 band. WLAN uses the frequency ranges 2400-2500 MHz and 5160-5825 MHz, which will be referred to herein as the WLAN 2.4 and WLAN 5 bands, respectively. GPS uses a frequency of 1575 MHz, which will be referred to herein as the GPS band.

Metropolitan area communication systems typically have a coverage radius of approximately 30 miles. An example of a metropolitan area communication system is WiMax band 3A, which uses a frequency range of 2496-2690 MHz. The term "WiMax" may be used generically hereinafter to refer to any metropolitan area communication system with such a coverage radius and such a frequency range, but it should be understood that such a system is not necessarily a WiMax system. Such a frequency range may be referred to hereinafter as the WiMax band.

Short-range communication systems may have a coverage radius of less than 100 meters. An example of a short-range communication system is Bluetooth, which uses a frequency range of 2400-2484 MHz. The term "Bluetooth" may be used generically hereinafter to refer to any short-range communication system with such a coverage radius and such a frequency range, but it should be understood that such a system is not necessarily a Bluetooth system. Such a frequency range may be referred to herein as the Bluetooth band.

An antenna designed to transmit or receive on one of the bands mentioned above may be referred to by the respective band name. For example, an antenna designed to receive GPS signals may be referred to as a GPS antenna.

Antennas such as those described above may be used in numerous different types of devices, such as mobile telephones, personal digital assistants, handheld computers, laptop computers, tablet computers, or similar devices. As used herein, terms such as "mobile handset", "wireless device", and the like may be used to refer to such devices, but it should be understood that the embodiments disclosed herein may be applicable to any type of device that may be equipped with any of these types of antennas, even if the device is not transportable.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

It should be understood at the outset that although illustrative implementations of one or more aspects of the present disclosure are provided below, the disclosed systems and/or methods may be implemented using any number of techniques, whether currently known or developed in the future. The disclosure should in no way be limited to the illustrative implementations, drawings, and techniques illustrated below, including the example designs and implementations illustrated and described herein, but may be modified within the scope of the appended claims along with their full scope of equivalents.

Figure 1:
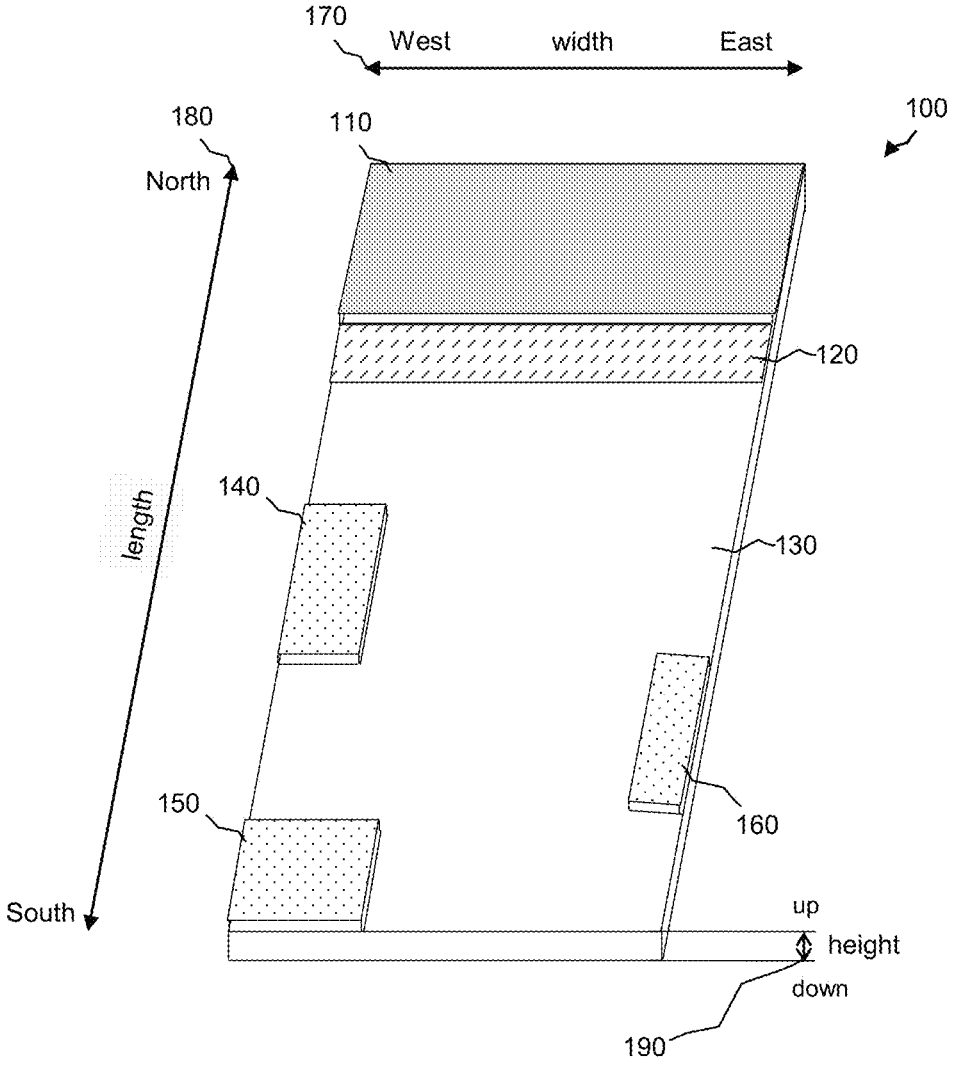
Figure 1 (prior art)
FIG. 1 illustrates a printed circuit board that includes a plurality of antenna carriers according to the prior art.

FIG. 1 illustrates a typical printed circuit board (PCB) 100 for a mobile handset or other wireless device. A main antenna carrier 110 is disposed on the largest surface of the PCB 100. The main antenna carrier 110 is a thin block of material that fills a volume along a shorter edge of the largest surface of the PCB 100. One or more antennas designed to cover the GSM 850 band and/or the GSM 1800/1900 band may be present in the main antenna carrier 110. The antennas are conductive traces that may be printed on one or more surfaces of the main antenna carrier 110 or may be embedded within the main antenna carrier 110. The main antenna carrier 110 is typically made of plastic or some other material that has a low relative permittivity.

The main antenna carrier 110 is typically disposed on a ground clearance area 120 on an upper portion of the PCB 100. That is, a lower portion 130 of the PCB 100 may be substantially covered with a conducting material, and an upper portion of the PCB 100 may be substantially covered with a non-conducting material that is referred to as the ground clearance area 120. The width of the PCB 100, the main antenna carrier 110, and the ground clearance area 120 are approximately the same, but the length of the ground clearance area 120 is typically slightly larger than the length of the main antenna carrier 110. Therefore, a portion of the ground clearance area 120 extends beyond the length of the main antenna carrier 110 toward the lower portion 130 of the PCB 100.

If antennas in addition to the GSM antennas are to be included on the PCB 100, the additional antennas are typically not included in the main antenna carrier 110 due to a lack of space and/or concerns about possible performance degradation that may occur when multiple different types of antennas are placed in close proximity to one another. Therefore, the additional antennas are typically included in additional antenna volumes that are spread across the PCB 100 in locations relatively far from one another and from the main antenna carrier 110. These additional antenna carriers may have different shapes and volumes that are appropriate for the types of antennas that they carry. For example, a first additional antenna carrier 140 may include an antenna for the WiMax band, a second additional antenna carrier 150 may include an antenna for the GPS band, and a third additional antenna carrier 160 may include an antenna for one or more WLAN bands. Such additional antenna carriers may be placed in locations other than those shown in FIG. 1, and the sizes and shapes of the additional antenna carriers may be different from those shown.

For ease of reference in the discussion herein, several dimensions and relative directions may be defined with respect to the components in FIG. 1. It should be understood that any directions or dimensions referred to in the discussion herein are relative directions or dimensions with respect to other components and should not be construed in a limiting manner regarding how the components discussed herein may be internally configured or arranged on the PCB 100. Also, while these dimension and direction definitions are provided with regard to the prior art PCB 100, it should be understood that these definitions may apply as well to the embodiments described below.

The dimension shared in common by the PCB 100, the main antenna carrier 110, and the ground clearance area 120 may be considered a width, as indicated by arrow 170. The dimension of the PCB 100 defined by perpendicular movement between the main antenna carrier 110 and the additional antenna carriers 140, 150, and 160 may be considered a length, as indicated by arrow 180. The dimension of the PCB 100 defined by perpendicular movement between the main antenna carrier 110 and the surface of the PCB 100 may be considered a height, as indicated by arrow 190.

Perpendicular movement from the main antenna carrier 110 to the surface of the PCB 100 may be considered downward movement, and perpendicular movement to the main antenna carrier 110 from the surface of the PCB 100 may be considered upward movement. The side of the PCB 100 on which the main antenna carrier 110 and the additional antenna carriers 140, 150, and 160 are disposed can be considered the upper side. The side of the PCB 100 perpendicular to the upper side in a downward direction can be consider the lower side.

The portion of the upper side of the PCB 100 on which the first additional antenna carrier 140 and the second additional antenna carrier 150 are depicted can be considered the west portion, and the side of the PCB 100 adjacent to the west portion can be considered the left side. The portion of the upper side of the PCB 100 on which the third additional antenna carrier volume 160 is depicted can be considered the east portion, and the side of the PCB 100 adjacent to the east portion can be considered the right side.

The portion of the upper side of the PCB 100 on which the main antenna carrier 110 is depicted can be considered the north portion, and the side of the PCB 100 adjacent to the north portion can be considered the back side. The portion of the upper side of the PCB 100 opposite the main antenna carrier 110 in a lengthwise direction can be considered the south portion, and the side of the PCB 100 adjacent to the south portion can be considered the front side.

The PCB 100 typically has a width of approximately 50 millimeters (mm) and a length of approximately 110 mm. The ground clearance area 120 typically has a width of approximately 50 mm and a length of approximately 14 mm. The main antenna carrier 110 typically has a width of approximately 50 mm, a length of approximately 10 mm, and a height of approximately 3 mm.

Embodiments of the present disclosure allow a plurality of antennas in addition to GSM antennas to be included on a main antenna carrier on a PCB. More specifically, a GSM 850 antenna, a GSM 1800/1900 antenna, a WLAN 2.4 antenna, a WLAN 5 antenna, a WiMax antenna, a Bluetooth antenna, a GPS antenna, or any combination of such antennas may be included on a main antenna carrier on a PCB. In an embodiment, the WLAN 2.4, WLAN 5, WiMax, Bluetooth, and GPS antennas are combined in a first antenna array that may be referred to as the auxiliary antenna array, and the GSM 850 and GSM 1800/1900 antennas are combined in a second antenna array that may be referred to as the cellular antenna array.

Figure 2:
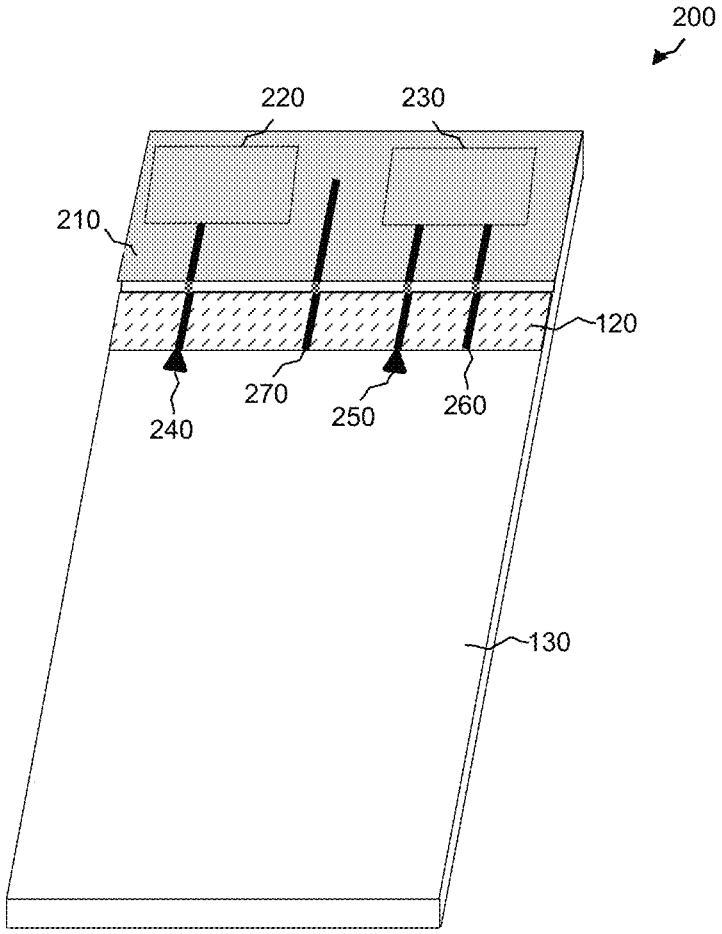
FIG. 2 illustrates a printed circuit board that includes an antenna carrier according to an implementation of the disclosure.

FIG. 2 illustrates a PCB 200 that includes such a main antenna carrier 210. An auxiliary antenna array 220 is disposed on a first portion of the main antenna carrier 210, and a cellular antenna array 230 is disposed on a second portion of the main antenna carrier 210. The internal structures of the auxiliary antenna array 220 and the cellular antenna array 230 will be described in detail below. The auxiliary antenna array 220 is fed by a first port 240, and the cellular antenna array 230 is fed by a second port 250. The two feeds support an easier selection of radio frequency (RF) chipsets and allow simple switching between bands without the use of a multiplexer. A ground trace 260 is also connected to the cellular antenna array 230.

The combination of the auxiliary antenna array 220 and the cellular antenna array 230 could be considered a single multiband antenna. However, the auxiliary antenna array 220 and the cellular antenna array 230 do not necessarily have to be used in combination with one another. The auxiliary antenna array 220 could stand alone without the cellular antenna array 230, and the cellular antenna array 230 could stand alone without the auxiliary antenna array 220.

In an embodiment, the main antenna carrier 210 is made of a ceramic material with a relative permittivity ($\in$) of approximately 6.5 and a loss tangent of approximately 0.0025. In other embodiments, other relative permittivities may be used, but it may be expected that a relative permittivity of at least 6 may provide the effects described herein, as will be described in more detail below. The composition and relative permittivity of the main antenna carrier 210 may be compared with previous antenna carriers that are typically made of plastic and have a relative permittivity of approximately 3. The high permittivity of the main antenna carrier 210 allows the traces that are used for the antennas on the main antenna carrier 210 to be shorter than the traces that are used for similar antennas on previous antenna carriers while still providing equivalent performance. The shorter traces, in turn, allow a larger number of antennas to be placed in a smaller space than would be possible with previous antenna carriers. Therefore, antennas for GSM 850, GSM 1800/1900, WLAN 2.4, WLAN 5, WiMax, Bluetooth, and GPS can all be included on a single antenna carrier 210 rather than being distributed across multiple antenna carriers as was the case in FIG. 1.

Placing the auxiliary antenna array 220 and the cellular antenna array 230 near one another on the same antenna carrier could theoretically cause undesirable coupling between the auxiliary antenna array 220 and the cellular antenna array 230. In an embodiment, such coupling is reduced by placing a shorting strip 270 between the auxiliary antenna array 220 and the cellular antenna array 230. The shorting strip 270 connects to the PCB ground to mitigate mutual coupling between the two antenna arrays 220 and 230.

In an alternative embodiment, the auxiliary antenna array 220 and the cellular antenna array 230 may be disposed on separate antenna carriers. In this case, the shorting strip may not be necessary.

Figure 3:
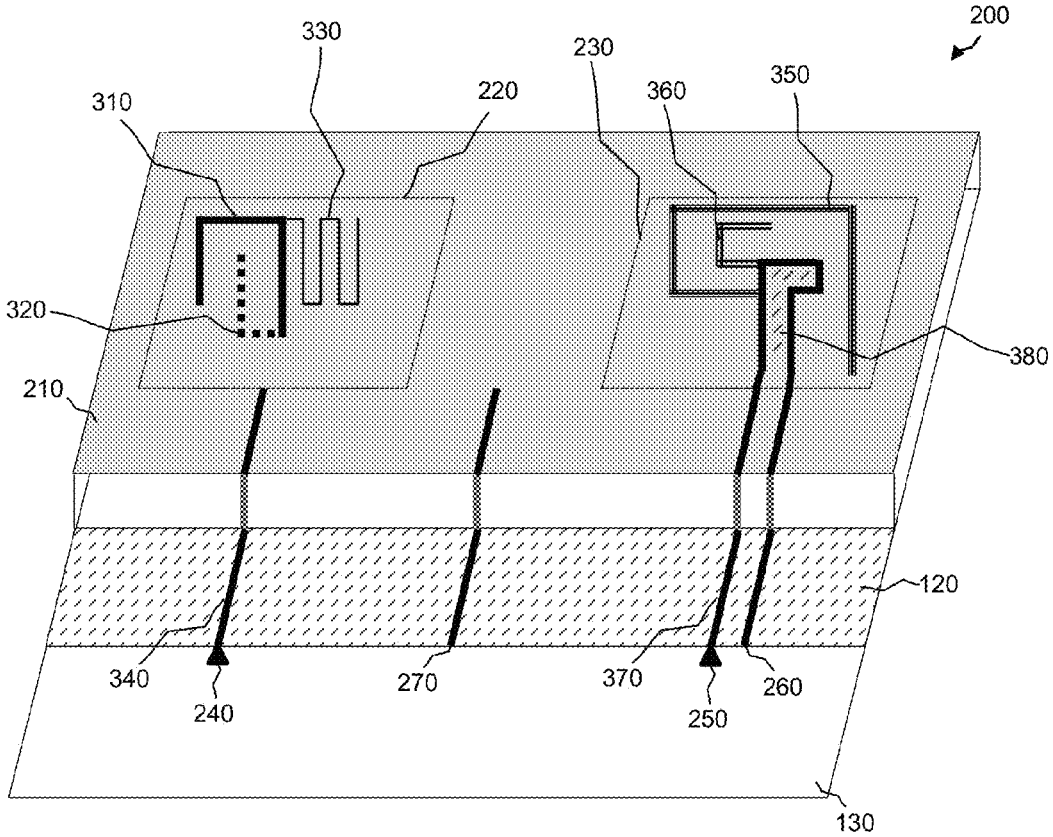
FIG. 3 illustrates a close-up view of a printed circuit board that includes an antenna carrier according to an implementation of the disclosure.

FIG. 3 provides a more detailed view of the components on and near the main antenna carrier 210. FIG. 3 is intended to be an idealized, not-to-scale, two-dimensional depiction of the auxiliary antenna array 220 and the cellular antenna array 230 and does not necessarily depict the actual configuration of the antennas in the two arrays 220 and 230. For example, all of the antennas in FIG. 3 are depicted on the upper surface of the main antenna carrier 210, but some of the antennas may actually be located on a side surface or the lower surface of the main antenna carrier 210. Details regarding embodiments of various three dimensional configurations of the antennas in the auxiliary antenna array 220 and the cellular antenna array 230 will be provided below.

In an embodiment, the auxiliary antenna array 220 is a set of monopole antennas that includes three components: a C-shaped antenna 310 for the WLAN 2.4, WiMax, and Bluetooth bands, an L-shaped antenna 320 for the WLAN 5 band, and a meander-shaped antenna 330 for the GPS band. The auxiliary antenna array 220 is connected to the first port 240 through a first feed trace 340. As will be described in more detail below, at least a portion of the longer leg of the L-shaped antenna 320 overlaps with the space created by the two parallel legs of the C-shaped antenna 310. This overlap creates a coupling between the C-shaped antenna 310 and the L-shaped antenna 320 that allows the C-shaped antenna 310 and the L-shaped antenna 320 to constructively work together to improve their responses in their respective frequency bands.

In an embodiment, the cellular antenna array 230 includes a first planar inverted F antenna (PIFA) that acts as a GSM 850 antenna 350 and a second PIFA that acts as a GSM 1800/1900 antenna 360. The cellular antenna array 230 is connected to the second port 250 through a second feed trace 370. The cellular antenna array 230 is also connected to the ground trace 260. The second feed trace 370 and the ground trace 260 are shaped such that an L-shaped gap or slot 380 exists between them. As will be described in more detail below, the L-shaped slot 380 can aid in impedance matching between the GSM 850 antenna 350 and the GSM 1800/1900 antenna 360.

Figure 4:
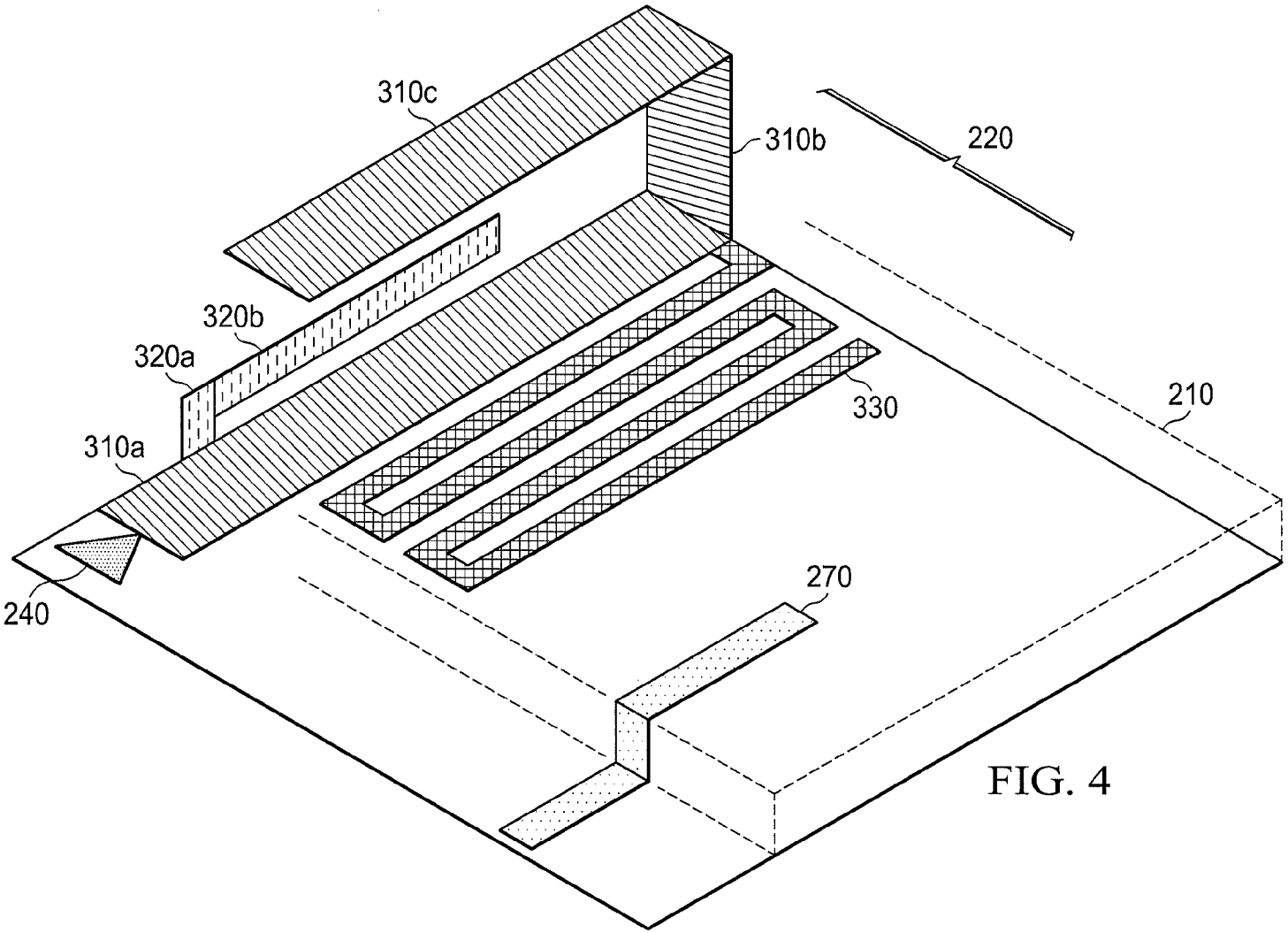
FIG. 4 illustrates a close-up view of a portion of a printed circuit board that includes an antenna array, according to an implementation of the disclosure.

FIG. 4 illustrates a not-to-scale, close-up view of the portion of the main antenna carrier 210 that includes the auxiliary antenna array 220. The entirety of the main antenna carrier 210 is not depicted in FIG. 4 so that an embodiment of a configuration of the antennas in the auxiliary antenna array 220 on and around the main antenna carrier 210 can be more clearly seen. Dotted lines suggest where the main antenna carrier 210 would be located if it were depicted in its entirety. The traces in FIG. 4 depict idealized versions of the C-shaped antenna 310, the L-shaped antenna 320, and the meander-shaped antenna 330. The traces show one possible configuration of the legs of the three antennas, but in other embodiments, the legs could have different internal orientations or different orientations with respect to one another.

In an embodiment, the C-shaped antenna 310 in the auxiliary antenna array 220 is a trace that includes a first portion 310*a* on the lower side of the main antenna carrier 210, a second portion 310*b* on the back side of the main antenna carrier 210, and a third portion 310*c* on the upper side of the main antenna carrier 210. In other embodiments, the portions of the C-shaped antenna 310 could be on other sides of the main antenna carrier 210 or could be internal to the main antenna carrier 210. In an embodiment, the left-most portions of the C-shaped antenna 310 are adjacent to the left side of the main antenna carrier 210. The portions of the C-shaped antenna 310 create an overall length of the C-shaped antenna 310 that is appropriate for the WLAN 2.4, WiMax, and Bluetooth bands.

In an embodiment, the L-shaped antenna 320 in the auxiliary antenna array 220 includes a first portion 320*a* and a second portion 320*b* both on the left side of the main antenna carrier 210. In other embodiments, the portions of the L-shaped antenna 320 could be on other sides of the main antenna carrier 210 or could be internal to the main antenna carrier 210. The portions of the L-shaped antenna 320 create an overall length of the L-shaped antenna 320 that is appropriate for the WLAN 5 band. In the embodiment of FIG. 4, the L-shaped antenna 320 is physically coupled to the C-shaped antenna 310 near the first port 240, but in other embodiments, the L-shaped antenna 320 may be physically coupled to the C-shaped antenna 310 in other locations.

In an embodiment, at least a portion of the longer leg 320*b* of the L-shaped antenna 320 overlaps with the space created by the two parallel legs 310*a* and 310*c* of the C-shaped antenna 310. In other words, if the plane of the upper portion 310*c* of the C-shaped antenna 310 is extended perpendicularly to the long dimension of the upper portion 310*c* of the C-shaped antenna 310, then at least a portion of the longer leg 320*b* of the L-shaped antenna 320 would lie below that extended plane. The overlap between the longer leg 320*b* of the L-shaped antenna 320 and the two parallel legs 310*a* and 310*c* of the C-shaped antenna 310 creates a capacitance between the L-shaped antenna 320 and the C-shaped antenna 310. This capacitance can combine with the inherent inductance of the traces of the L-shaped antenna 320 and the C-shaped antenna 310 to create one or more resonant frequencies. The lengths of the legs of the L-shaped antenna 320 and the C-shaped antenna 310, the amount of overlap between the longer leg 320*b* of the L-shaped antenna 320 and the space created by the two parallel legs 310*a* and 310*c* of the C-shaped antenna 310, and the distance between the longer leg 320*b* of the L-shaped antenna 320 and the two parallel legs 310*a* and 310*c* of the C-shaped antenna 310 can be adjusted to adjust these resonant frequencies. The adjustment can be made in a manner that is appropriate for the performance of the L-shaped antenna 320 and the C-shaped antenna 310 in the WLAN 2.4, WLAN 5, WiMax, and Bluetooth bands.

In the example of FIG. 4, the plane of the L-shaped antenna 320 is perpendicular to the planes of the two parallel legs 310*a* and 310*c* of the C-shaped antenna 310. Also, since the L-shaped antenna 320 is on the left side of the main antenna carrier 210 and the two parallel legs 310*a* and 310*c* of the C-shaped antenna 310 are on the lower and upper sides of the main antenna carrier 210, respectively, the L-shaped antenna 320 is not physically inserted into the gap in the C-shaped antenna 310. In other embodiments, the L-shaped antenna 320 may be oriented in different directions with respect to the C-shaped antenna 310. For example, the L-shaped antenna 320 may be physically inserted into the gap in the C-shaped antenna 310 by embedding the L-shaped antenna 320 inside the main antenna carrier 210. This may allow the plane of L-shaped antenna 320 to be disposed in a parallel manner or in some other orientation with respect to the two parallel legs 310*a* and 310*c* of the C-shaped antenna 310. However, the manufacturing costs that may be associated with embedding the L-shaped antenna 320 inside the main antenna carrier 210 may preclude such an orientation of the L-shaped antenna 320. In addition, the capacitance between the L-shaped antenna 320 and the C-shaped antenna 310 is not significantly changed by orienting the L-shaped antenna 320 in a manner other than that shown in FIG. 4.

In an embodiment, the meander-shaped antenna 330 in the auxiliary antenna array 220 has an overall length such that GPS transmissions can be received appropriately. The individual legs of the meander-shaped antenna 330 have lengths, widths, and spacings between one another that are appropriate for GPS signal reception. In the embodiment of FIG. 4, the meander-shaped antenna 330 is physically coupled to the C-shaped antenna 310 near the back side of the main antenna carrier 210, but in other embodiments, the meander-shaped antenna 330 may be physically coupled to the C-shaped antenna 310 in other locations.

The multi-band operation of the auxiliary antenna array 220 results from the triple fundamental modes of the three quarter-wavelength monopoles. The wide bandwidth is caused by the increase in antenna volume and is enhanced by the use of the high dielectric ceramic material of the main antenna carrier 210. The C-shaped antenna 310 provides resonances around 2.5 gigahertz (GHz), and its width can fine tune the bandwidth. The meander-shaped antenna 330 also enhances the bandwidth. The trace length of the C-shaped antenna 310 determines the center frequency of the combined WLAN 2.4 and WiMax bands. These constructively tied traces provide enough bandwidth to cover the WLAN 2.4, Bluetooth, and WiMax bands. The L-shaped antenna 320 protruding into the C-shaped antenna 310 results in the required bandwidth for the WLAN 5 band. Typically, a single monopole antenna inherently cannot provide sufficient bandwidth to cover 5160-5825 MHz and may need to rely on neighboring materials and parts, some of which may have a negative effect on the antenna. The use of the high-dielectric, low-loss ceramic material in the main antenna carrier 210, which is relatively thick for 5 GHz compared to the GSM band, can significantly improve the bandwidth without a loss of radiation performance.

Figure 5:
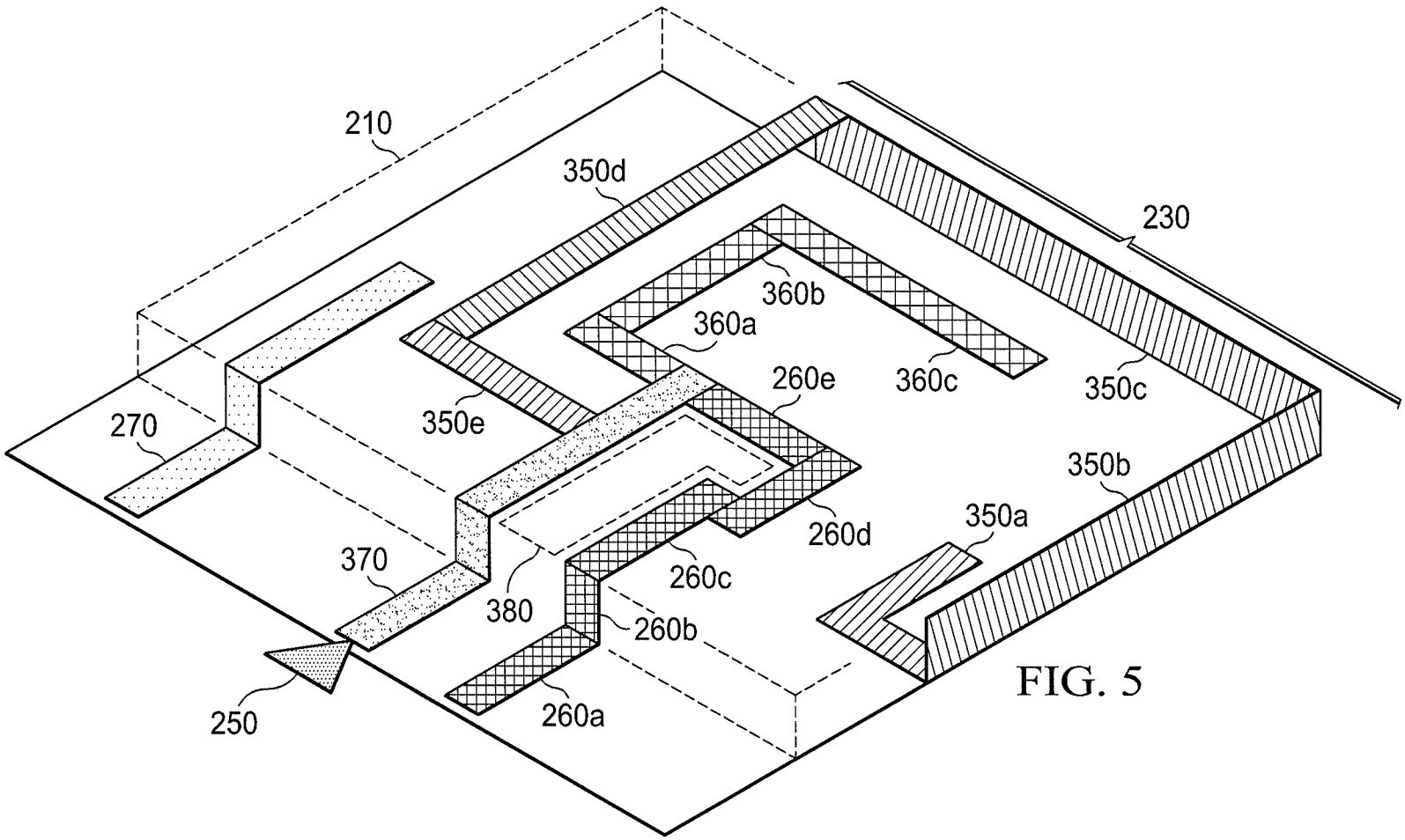
FIG. 5 illustrates a close-up view of another portion of a printed circuit board that includes an antenna array, according to an implementation of the disclosure.

FIG. 5 illustrates a not-to-scale, close-up view of the portion of the main antenna carrier 210 that includes the cellular antenna array 230. As in FIG. 4, the location of the main antenna carrier 210 is merely suggested by dotted lines rather than being depicted in its entirety so that an embodiment of a configuration of the antennas in the cellular antenna array 230 on and around the main antenna carrier 210 can be more clearly seen. The traces in FIG. 5 depict idealized versions of the GSM 850 antenna 350 and the GSM 1800/1900 antenna 360 that show one possible configuration of the legs of the two antennas. In other embodiments, the legs could have different internal orientations or different orientations with respect to one another.

The shorting strip 270 is shown in both FIG. 4 and FIG. 5 to act as a reference point for one possible manner in which the auxiliary antenna array 220 of FIG. 4 and the cellular antenna array 230 of FIG. 5 could be oriented with respect to one another. In other embodiments, the auxiliary antenna array 220 and the cellular antenna array 230 could be oriented with respect to one another in other ways.

In an embodiment, the GSM 850 antenna 350 in the cellular antenna array 230 is a trace that includes a first portion 350*a* on the lower side of the main antenna carrier 210, a second portion 350*b* on the right side of the main antenna carrier 210, a third portion 350*c* on the back side of the main antenna carrier 210, a fourth portion 350*d* on the upper side of the main antenna carrier 210, and a fifth portion 350*e* on the upper side of the main antenna carrier 210 perpendicular to the fourth portion 350*d*. The fifth portion 350*e* abuts perpendicularly into the west side of the second feed trace 370.

In an embodiment, the GSM 1800/1900 antenna 360 in the cellular antenna array 230 is a trace that includes a first portion 360*a* on the upper side of the main antenna carrier 210. The first portion 360*a* abuts perpendicularly into the west side of the second feed trace 370 north of the location where the fifth portion 350*e* of the GSM 850 antenna 350 abuts into the second feed trace 370. The first portion 360*a* ends at a location east of the fourth portion 350*d* of the GSM 850 antenna 350. A second portion 360*b* of the GSM 1800/1900 antenna 360 abuts the west end of the north side of the first portion 360*a* and is perpendicular to the first portion 360*a*. The second portion 360*b* ends at a location south of the third portion 350*c* of the GSM 850 antenna 350. A third portion 360*c* of the GSM 1800/1900 antenna 360 abuts the north end of the second portion 360*b* and extends eastward perpendicularly from the second portion 360*b*. The third portion 360*c* ends at a location east of the second feed trace 370 and west of the second portion 350*b* of the GSM 850 antenna 350.

Thus, it can be seen that the first, second, and third portions of the GSM 1800/1900 antenna 360 form, on the upper side of the main antenna carrier 210, an approximate C shape, with the leg formed by first portion 360*a* shorter than the leg formed by the third portion 360*c*. The west and south sides of this C shape are inside and parallel to the fourth and fifth portions, respectively, of the GSM 850 antenna 350.

The ground trace 260 includes a first portion 260*a* in the ground clearance area 120 and a second portion 260*b* that rises to the upper side of the main antenna carrier 210. Additional portions 260*c*, 260*d*, and 260*e* on the upper side of the main antenna carrier 210 form an irregular shape, one end of which abuts the rising portion 260*b* of the ground trace 260 and the other end of which abuts the north end of the east side of the second feed trace 370. This irregular shape and the portion of the second feed trace 370 that is on the upper side of the main antenna carrier 210 combine to outline the L-shaped slot 380 on the upper side of the main antenna carrier 210.

The two major traces in the cellular antenna array 230 provide two resonances at low-band and high-band, which are controlled by the lengths of the traces. The long and short branched traces operate at 850 MHz and 1800/1900 MHz, respectively. The bandwidth at 1800/1900 MHz is further broadened by the second harmonic of the short trace 360. The L-shaped slot 380 formed by the second feed trace 370 and the ground trace 260 behaves like an inductor-capacitor (LC) impedance that matches circuits whose LC values can be controlled by the length and width of the slot 380. The L-shaped slot 380 can help impedance matching especially for the low band.

Figure 6:
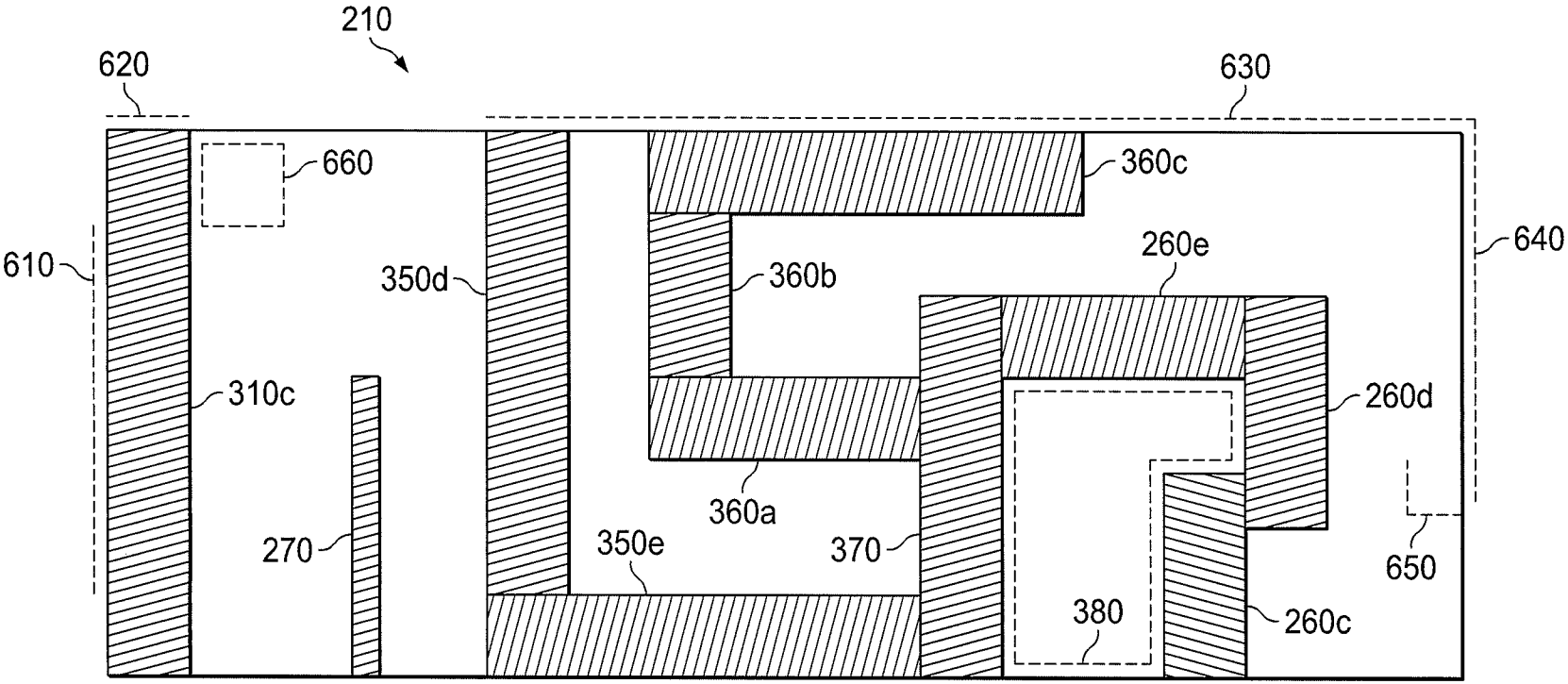
FIG. 6 illustrates a view of the upper surface of an antenna carrier, according to an implementation of the disclosure.

To further clarify the relationships between the portions of the antennas in the auxiliary antenna array 220 and the cellular antenna array 230 and to provide a possible variation on those relationships, FIG. 6 depicts the upper surface of the main antenna carrier 210 from a view looking directly downward. The sizes, shapes, and distances in FIG. 6 are not to scale and do not necessarily depict the actual sizes, shapes, and positions of the components represented. The antennas may be continuous traces of conducting material but, for ease of description, may be described as consisting of portions or sections. That is, when the description herein refers to two portions abutting with one another or connecting to one another, it should be understood that the two portions may actually be a single entity that merely gives the appearance of abutting or connecting when the portions are considered to be blocks rather than continuous sections of a single trace.

The third portion 310*c* of the C-shaped antenna 310 occupies the left side of the upper surface of the main antenna carrier 210. The shorting strip 270 is between the third portion 310*c* of the C-shaped antenna 310 and the portions of the cellular antenna array 230 that are on the upper surface of the main antenna carrier 210.

The fourth portion 350*d* of the GSM 850 antenna 350 is parallel to the shorting strip 270 and to the third portion 310*c* of the C-shaped antenna 310 and extends southward from the north side of the main antenna carrier 210. The fourth portion 350*d* of the GSM 850 antenna 350 abuts with the north side of the fifth portion 350*e* of the GSM 850 antenna 350. The fifth portion 350*e* of the GSM 850 antenna 350 is perpendicular to the fourth portion 350*d* of the GSM 850 antenna 350 and is adjacent to the south edge of the main antenna carrier 210. The east side of the fifth portion 350*e* of the GSM 850 antenna 350 abuts the west side of the second feed trace 370.

The second feed trace 370 is perpendicular to the fifth portion 350*e* of the GSM 850 antenna 350 and extends northward to a point south of the north edge of the main antenna carrier 210. The first portion 360*a* of the GSM 1800/1900 antenna 360 extends perpendicularly westward from the second feed trace 370 from a point north of the point where the fifth portion 350*e* of the GSM 850 antenna 350 abuts the second feed trace 370. The first portion 360*a* of the GSM 1800/1900 antenna 360 ends at a point east of the fourth portion 350*d* of the GSM 850 antenna 350. The second portion 360*b* of the GSM 1800/1900 antenna 360 extends perpendicularly northward from the first portion 360*a* of the GSM 1800/1900 360 antenna at the western edge of the first portion 360*a* of the GSM 1800/1900 antenna 360. The second portion 360*b* of the GSM 1800/1900 antenna 360 abuts the south side of the third portion 360*c* of the GSM 1800/1900 antenna 360 near the western edge of the third portion 360*c* of the GSM 1800/1900 antenna 360. The third portion 360*c* of the GSM 1800/1900 antenna 360 is adjacent to the north edge of the main antenna carrier 210. The third portion 360*c* of the GSM 1800/1900 antenna 360 extends perpendicularly eastward from the second portion 360*b* of the GSM 1800/1900 antenna 360 and ends at a location west of the eastern edge of the main antenna carrier 210 and east of the second feed trace 370.

The fifth portion 260*e* of the ground trace 260 extends perpendicularly eastward from the eastern edge of the second feed trace 370 near the northern end of the second feed trace 370. The fifth portion 260*e* of the ground trace 260 abuts the western edge of the fourth portion 260*d* of the ground trace 260 near the northern end of the fourth portion 260*d* of the ground trace 260. The fourth portion 260*d* of the ground trace 260 extends perpendicularly southward to a point north of the southern edge of the main antenna carrier 210. The third portion 260*c* of the ground trace 260 extends parallel to the fourth portion 260*d* of the ground trace 260. A portion of the east side of the north end of the third portion 260*c* of the ground trace 260 is adjacent to a portion of the west side of the south end of the fourth portion 260*d* of the ground trace 260. The south end of the third portion 260*c* of the ground trace 260 extends to the south edge of the main antenna carrier 210.

The east edge of the second feed trace 370, the south edge of the fifth portion 260*e* of the ground trace 260, the west edge of the fourth portion 260*d* of the ground trace 260, and the north and west edges of the third portion 260*c* of the ground trace 260 form the L-shaped slot 380 described above.

The portions of the antenna traces that are on the sides and the lower surface of the main antenna carrier 210 are not visible in this downward view, but dashed lines have been included in FIG. 6 to represent the approximate locations where those portions of the traces would be located. Line 610 indicates the approximate location of the L-shaped antenna 320 on the left side of the main antenna carrier 210. Line 620 indicates the approximate location of the second portion 310*b* of the C-shaped antenna 310 on the back side of the main antenna carrier 210. Line 630 indicates the approximate location of the third portion 350*c* of the GSM 850 antenna 350 on the back side of the main antenna carrier 210. Line 640 indicates the approximate location of the second portion 350*b* of the GSM 850 antenna 350 on the right side of the main antenna carrier 210. Lines 650 indicate the approximate location of the first portion 350*a* of the GSM 850 antenna 350 on the lower side of the main antenna carrier 210. Box 660 indicates the approximate location of the meander-shaped antenna 330 on the lower side of the main antenna carrier 210. The first portion 310*a* of the C-shaped antenna 310 is located on the lower side of the main antenna carrier 210 at approximately the same location where the third portion 310*c* of the C-shaped antenna 310 is depicted on the upper side of the main antenna carrier 210.

In an embodiment, the main antenna carrier 210 may have dimensions of approximately 50×10×3 mm. The cellular antenna array 230 may have dimensions of approximately 30×10×3 mm, and the auxiliary antenna array 230 may have dimensions of approximately 10×10×3 mm.

As mentioned above, in an embodiment, the permittivity of the main antenna carrier 210 is approximately 6.5. If the permittivity were made larger than 6.5, further reductions in size may be made to the antennas on the main antenna carrier 210. This may allow additional antennas that cover other frequency bands to be placed on the main antenna carrier 210. However, the efficiency of the antennas may decrease as the size of the antennas decreases, and the efficiency may become unacceptably low if the size of the antennas is decreased too much. If the permittivity were made smaller than 6.5, the size of the antennas described herein may have to increase, and the likelihood of fitting all of the antennas onto the main antenna carrier 210 may decrease. However, a permittivity of at least 6 may provide the effects described herein.

In addition, it has been found that if the thickness of the main antenna carrier 210 is reduced, the embodiments described herein are still valid. However, in this case, the total length of each trace may need to be extended to compensate for the frequency shift. The trace widths may also need to change accordingly to retain the wide bandwidth.

Current distribution testing performed on the cellular antenna array and the auxiliary antenna array at various operating frequencies indicates that the cellular antenna radiation relies on the element as well as the PCB ground, while the auxiliary antenna array mainly depends on the radiating element. The PIFA antenna for 850 MHz provides longer current distribution on the trace and gives shorter current distribution at 1800/1900 MHz. The impedance matching from the L-shaped slot of the cellular antenna array is also apparent from current distribution testing, as the current around the L-shaped slot is strong. In the auxiliary antenna array, the resonance at 1575 MHz occurs at the meander-shaped antenna. At 2.5 GHz, the current is strong at the C-shaped antenna and some of the meander-shaped antenna, which increases overall antenna volume and hence provides a high radiation efficiency. At 5 GHz, the energy from the L-shaped antenna is coupled to the C-shaped antenna.

S-parameter testing was also performed, where the threshold of the required bandwidth for each band is −6 dB as is generally accepted for handset antennas. The cellular antenna array is able to support the GSM 850, GSM 1800, and GSM 1900 bands. The auxiliary antenna array has an extremely wide bandwidth in each supported band, especially the 5 GHz WLAN band (IEEE 802.11a). The shorting strip placed between the cellular and auxiliary antenna arrays has been shown to assist in providing port-to-port isolation. In most of the bands, the isolation is better than −12.5 dB. The shorting strip improves the mutual coupling by 4 dB at critical bands. In the GSM 1800/1900, WLAN 2.4, and WiMax bands, the isolation can be improved by 14 to 20 dB. Since the GPS antenna is for receiving purposes only and does not transmit any power, the lower isolation may not be as significant as in other bands.

Testing was also performed for measured-total efficiency and peak gain including all GSM, GPS, WLAN (2.4 and 5 GHz), Bluetooth, and WiMax bands. The peak efficiencies of the cellular antenna array at GSM low/high band are about 60% to 70%. For the auxiliary antenna array, the efficiency at 1575 MHz is 36%. The average efficiencies in 2400-2700 MHz and 5150-5825 MHz are 50% and 40%, respectively, while their peaks are 65% and 49%.

The embodiments of the present disclosure provide a compact, multi-band antenna that can support the worldwide operation of mobile phones. The antenna has two feeding ports for ease of band selection and has an electrically small dimension. The covered frequencies include popular bands of cellular and wireless local networks such as GSM, GPS, WLAN (2.4 and 5 GHz), WiMax, and Bluetooth. The antenna is printed on a low-loss ceramic material, which can allow the size of the antenna to be shrunk by approximately 25% compared to previous commercial handset antenna sizes. The two-port antenna can be divided into two independent antennas that can be separated from one another for placement flexibility.

Figure 7:
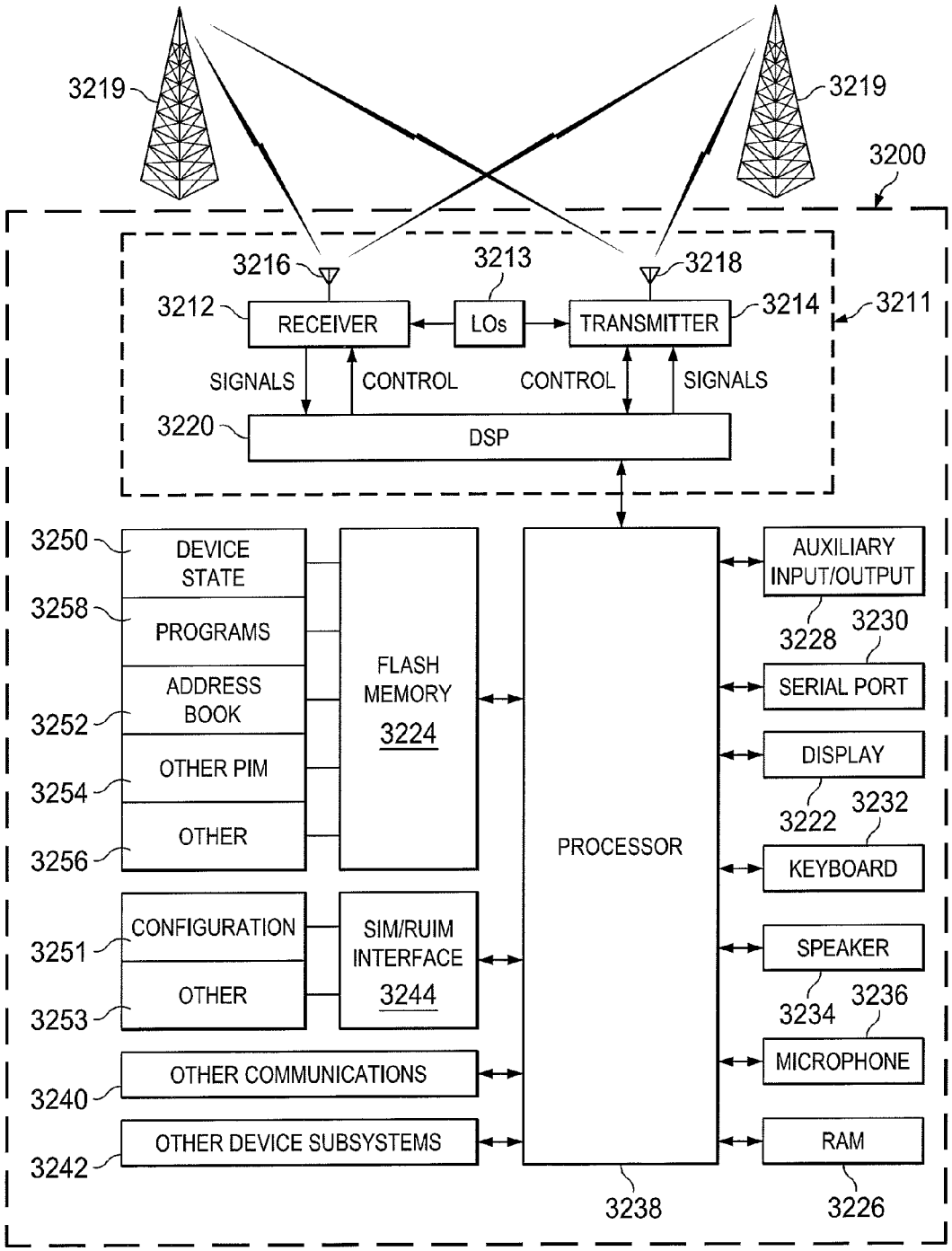
FIG. 7 illustrates a wireless device suitable for implementing the several aspects of the present disclosure.

As mentioned above, the embodiments described herein may be implemented by mobile telephones, personal digital assistants, handheld computers, laptop computers, tablet computers, or other types of devices. An example of such a device is described below with regard to FIG. 7. Device 3200 may comprise a two-way wireless communication device having voice and data communication capabilities. In some embodiments, voice communication capabilities are optional. The device 3200 generally has the capability to communicate with other computer systems on the Internet. Depending on the exact functionality provided, the device may be referred to as a data messaging device, a two-way pager, a wireless e-mail device, a cellular telephone with data messaging capabilities, a wireless Internet appliance, a wireless device, a smart phone, a mobile device, or a data communication device, as examples.

Where the device 3200 is enabled for two-way communication, it may incorporate a communication subsystem 3211, including a receiver 3212 and a transmitter 3214, as well as associated components such as one or more antenna elements 3216 and 3218, local oscillators (LOs) 3213, and a processing module such as a digital signal processor (DSP) 3220. The particular design of the communication subsystem 3211 may be dependent upon the communication network in which the device 3200 is intended to operate. While only two antenna elements 3216 and 3218 are shown, multiple antennas may be present, as described herein.

Network access requirements may also vary depending upon the type of network 3219. In some networks, network access is associated with a subscriber or user of the device 3200. The device 3200 may require a removable user identity module (RUIM) or a subscriber identity module (SIM) card in order to operate on a network. The SIM/RUIM interface 3244 is typically similar to a card slot into which a SIM/RUIM card may be inserted. The SIM/RUIM card may have memory and may hold many key configurations 3251 and other information 3253, such as identification and subscriber-related information.

When required network registration or activation procedures have been completed, the device 3200 may send and receive communication signals over the network 3219. As illustrated, the network 3219 may consist of multiple base stations communicating with the device 3200.

Signals received by antenna 3216 through communication network 3219 are input to receiver 3212, which may perform such common receiver functions as signal amplification, frequency down conversion, filtering, channel selection, and the like. Analog to digital (A/D) conversion of a received signal allows more complex communication functions, such as demodulation and decoding to be performed in the DSP 3220. In a similar manner, signals to be transmitted are processed, including modulation and encoding for example, by DSP 3220 and are input to transmitter 3214 for digital to analog (D/A) conversion, frequency up conversion, filtering, amplification, and transmission over the communication network 3219 via antenna 3218. DSP 3220 not only processes communication signals but also provides for receiver and transmitter control. For example, the gains applied to communication signals in receiver 3212 and transmitter 3214 may be adaptively controlled through automatic gain control algorithms implemented in DSP 3220.

The device 3200 generally includes a processor 3238 which controls the overall operation of the device. Communication functions, including data and voice communications, are performed through communication subsystem 3211. Processor 3238 also interacts with further device subsystems such as the display 3222, flash memory 3224, random access memory (RAM) 3226, auxiliary input/output (I/O) subsystems 3228, serial port 3230, one or more keyboards or keypads 3232, speaker 3234, microphone 3236, other communication subsystem 3240 such as a short-range communications subsystem, and any other device subsystems generally designated as 3242. Serial port 3230 may include a USB port or other port currently known or developed in the future.

Some of the illustrated subsystems perform communication-related functions, whereas other subsystems may provide "resident" or on-device functions. Notably, some subsystems, such as keyboard 3232 and display 3222, for example, may be used for both communication-related functions, such as entering a text message for transmission over a communication network, and device-resident functions, such as a calculator or task list.

Operating system software used by the processor 3238 may be stored in a persistent store such as flash memory 3224, which may instead be a read-only memory (ROM) or similar storage element (not shown). The operating system, specific device applications, or parts thereof, may be temporarily loaded into a volatile memory such as RAM 3226. Received communication signals may also be stored in RAM 3226.

As shown, flash memory 3224 may be segregated into different areas for both computer programs 3258 and program data storage 3250, 3252, 3254 and 3256. These different storage types indicate that each program may allocate a portion of flash memory 3224 for their own data storage requirements. Processor 3238, in addition to its operating system functions, may enable execution of software applications on the device 3200. A predetermined set of applications that control basic operations, including at least data and voice communication applications for example, may typically be installed on the device 3200 during manufacturing. Other applications may be installed subsequently or dynamically.

Applications and software may be stored on any computer-readable storage medium. The computer-readable storage medium may be tangible or in a transitory/non-transitory medium such as optical (e.g., CD, DVD, etc.), magnetic (e.g., tape), or other memory currently known or developed in the future.

One software application may be a personal information manager (PIM) application having the ability to organize and manage data items relating to the user of the device such as, but not limited to, e-mail, calendar events, voice mails, appointments, and task items. One or more memory stores may be available on the device to facilitate storage of PIM data items. Such a PIM application may have the ability to send and receive data items via the wireless network 3219. Further applications may also be loaded onto the device 3200 through the network 3219, an auxiliary I/O subsystem 3228, serial port 3230, short-range communications subsystem 3240, or any other suitable subsystem 3242, and installed by a user in the RAM 3226 or a non-volatile store (not shown) for execution by the processor 3238. Such flexibility in application installation may increase the functionality of the device 3200 and may provide enhanced on-device functions, communication-related functions, or both. For example, secure communication applications may enable electronic commerce functions and other such financial transactions to be performed using the device 3200.

In a data communication mode, a received signal such as a text message or web page download may be processed by the communication subsystem 3211 and input to the processor 3238, which may further process the received signal for output to the display 3222, or alternatively to an auxiliary I/O device 3228.

A user of device 3200 may also compose data items, such as email messages for example, using the keyboard 3232, which may be a complete alphanumeric keyboard or telephone-type keypad, among others, in conjunction with the display 3222 and possibly an auxiliary I/O device 3228. Such composed items may then be transmitted over a communication network through the communication subsystem 3211.

For voice communications, overall operation of the device 3200 is similar, except that received signals may typically be output to a speaker 3234 and signals for transmission may be generated by a microphone 3236. Alternative voice or audio I/O subsystems, such as a voice message recording subsystem, may also be implemented on the device 3200. Although voice or audio signal output may be accomplished primarily through the speaker 3234, display 3222 may also be used to provide an indication of the identity of a calling party, the duration of a voice call, or other voice call-related information, for example.

Serial port 3230 may be implemented in a personal digital assistant (PDA)-type device for which synchronization with a user's desktop computer (not shown) may be desirable, but such a port is an optional device component. Such a port 3230 may enable a user to set preferences through an external device or software application and may extend the capabilities of the device 3200 by providing for information or software downloads to the device 3200 other than through a wireless communication network. The alternate download path may, for example, be used to load an encryption key onto the device 3200 through a direct and thus reliable and trusted connection to thereby enable secure device communication. Serial port 3230 may further be used to connect the device to a computer to act as a modem.

Other communications subsystems 3240, such as a short-range communications subsystem, are further optional components which may provide for communication between the device 3200 and different systems or devices, which need not necessarily be similar devices. For example, the subsystem 3240 may include an infrared device and associated circuits and components or a Bluetooth™ communication module to provide for communication with similarly enabled systems and devices. Subsystem 3240 may further include non-cellular communications such as WiFi, WiMax, near field communication (NFC), and/or radio frequency identification (RFID). The other communications element 3240 may also be used to communicate with auxiliary devices such as tablet displays, keyboards or projectors.

In an implementation, a multi-band antenna component is provided. The multi-band antenna component comprises a carrier, a first antenna array, and a second antenna array. The carrier is composed of a ceramic material characterized by a permittivity of at least about 6, said carrier having a first region and a second region distinct from the first region. The first antenna array is disposed on the first region and comprises one or more antennas selected from the group consisting of a first antenna adapted for about 2.4 GHz wireless communication, a second antenna adapted for about 5 GHz wireless communication, and a third antenna adapted for wireless communication for a global positioning system. The second antenna array is disposed on the second region and comprises at least one of a fourth antenna adapted for about 850 MHz wireless communication or a fifth antenna adapted for about 1800/1900 MHz wireless communication.

In another implementation, a wireless communication device is provided. The device comprises a multi-band antenna component that includes a carrier, a first antenna array, and a second antenna array. The carrier is composed of a ceramic material characterized by a permittivity of at least about 6, said carrier having a first region and a second region distinct from the first region. The first antenna array is disposed on the first region and comprises one or more antennas selected from the group consisting of a first antenna adapted for about 2.4 GHz wireless communication, a second antenna adapted for about 5 GHz wireless communication, and a third antenna adapted for wireless communication for a global positioning system. The second antenna array is disposed on the second region and comprises at least one of a fourth antenna adapted for about 850 MHz wireless communication or a fifth antenna adapted for about 1800/1900 MHz wireless communication.

In another implementation, a wireless communication device is provided. The device comprises an antenna carrier and an antenna array disposed on the antenna carrier. The antenna array includes a first antenna adapted for about 2.4 GHz wireless communication, a second antenna adapted for about 5 GHz wireless communication, and a third antenna adapted for wireless communication for a global positioning system.

While several implementations have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

Also, techniques, systems, subsystems and methods described and illustrated in the various implementations as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component, whether electrically, mechanically, or otherwise. Other examples of changes, substitutions, and alterations are ascertainable by one skilled in the art and may be made without departing from the spirit and scope disclosed herein.

What is claimed is:

1. A multi-band antenna component comprising:

a carrier composed of a ceramic material characterized by a permittivity of at least about 6, said carrier having a first region and a second region distinct from the first region;

a first antenna array disposed on the first region and comprising one or more antennas selected from the group consisting of a first antenna adapted for about 2.4 gigahertz (GHz) wireless communication, a second antenna adapted for about 5 GHz wireless communication, and a third antenna adapted for wireless communication for a global positioning system; and a second antenna array disposed on the second region and comprising at least one of a fourth antenna adapted for about 850 megahertz (MHz) wireless communication or a fifth antenna adapted for about 1800/1900 MHz wireless communication.

2. The multi-band antenna component of claim 1, further comprising a shorting strip disposed on the carrier between the first region and the second region to reduce coupling between the first antenna array and the second antenna array.

3. The multi-band antenna component of claim 1, wherein the first antenna is adapted for a wireless communication system selected from the group consisting of a wireless local area network system, a wireless metropolitan area network system, and a wireless short-range communication system.

4. The multi-band antenna component of claim 3, wherein the wireless metropolitan area network system is a WiMax communication system.

5. The multi-band antenna component of claim 3, wherein the wireless short-range communication system is a Bluetooth communication system.

6. The multi-band antenna component of claim 1, wherein the second antenna is adapted for wireless communication for a wireless local area network.

7. The multi-band antenna component of claim 1, wherein the fourth antenna and the fifth antenna are adapted for a wireless communication system in accordance with a Global Systems for Mobile Communications standard.

8. The multi-band antenna component of claim 1, further comprising a first feed trace for coupling to the first antenna array and a second feed trace for coupling to the second antenna array.

9. The multi-band antenna component of claim 1, wherein the first antenna is a monopole antenna characterized generally by a C-shape having two substantially parallel legs, and wherein the second antenna is a monopole antenna characterized generally by an L-shape having a longer leg and a shorter leg, and wherein the third antenna is a monopole antenna characterized by a meander shape.

10. The multi-band antenna component of claim 9, wherein at least a portion of the longer leg of the L-shape of the second antenna lies below a plane created by an upper parallel leg of the C-shape of the first antenna.

11. The multi-band antenna component of claim 10, wherein the two parallel legs of the C-shape of the first antenna are disposed on opposite surfaces of the carrier, and wherein the portion of the longer leg of the L-shape of the second antenna is disposed on a side of the carrier between the opposite surfaces.

12. The multi-band antenna component of claim 1, wherein the fourth and fifth antennas are planar inverted F antennas (PIFAs); and wherein a first section of the fourth antenna extends perpendicularly from a feed trace, and a second section of the fourth antenna connects to an end of the first section of the fourth antenna opposite the feed trace and extends parallel to the feed trace in a direction opposite to a feed point of the feed trace; and wherein a first section of the fifth antenna connects to the feed trace at a point farther from the feed point than the point where the first section of the fourth antenna connects to the feed trace, and the first portion of the fifth antenna extends perpendicularly from the feed trace toward the second section of the fourth antenna to a point short of the second section of the fourth antenna, and a second section of the fifth antenna connects to an end of the first section of the fifth antenna opposite the feed trace and extends parallel to the feed trace in a direction opposite the feed point, and a third section of the fifth antenna connects to an end of the second section of the fifth antenna and extends parallel to the first section of the fifth antenna parallel in a direction toward the feed trace.

13. The multi-band antenna component of claim 12, wherein a ground trace connects to the feed trace on a side of the feed trace opposite the side where the fourth and fifth antennas connect to the feed trace, and wherein the ground trace has a shape such that the ground trace and the feed trace outline an L-shaped gap, with the feed trace forming the longest side of the L-shaped gap.

14. A wireless communication device comprising:

a multi-band antenna component that includes a carrier composed of a ceramic material characterized by a permittivity of at least about 6, said carrier having a first region and a second region distinct from the first region; that further includes a first antenna array disposed on the first region and comprising one or more antennas selected from the group consisting of a first antenna adapted for about 2.4 gigahertz (GHz) wireless communication, a second antenna adapted for about 5 GHz wireless communication, and a third antenna adapted for wireless communication for a global positioning system; and that further includes a second antenna array disposed on the second region and comprising at least one of a fourth antenna adapted for about 850 megahertz (MHz) wireless communication or a fifth antenna adapted for about 1800/1900 MHz wireless communication.

15. The device of claim 14, further comprising a shorting strip disposed on the carrier between the first region and the second region to reduce coupling between the first antenna array and the second antenna array.

16. The device of claim 14, wherein the first antenna is adapted for a wireless communication system selected from the group consisting of a wireless local area network system, a wireless metropolitan area network system, and a wireless short-range communication system.

17. The device of claim 16, wherein the wireless metropolitan area network system is a WiMax communication system.

18. The device of claim 16, wherein the wireless short-range communication system is a Bluetooth communication system.

19. The device of claim 14, wherein the second antenna is adapted for wireless communication for a wireless local area network.

20. The device of claim 14, wherein the fourth antenna and the fifth antenna are adapted for a wireless communication system in accordance with a Global Systems for Mobile Communications standard.

21. The device of claim 14, further comprising a first feed trace for coupling to the first antenna array and a second feed trace for coupling to the second antenna array.

22. The device of claim 14, wherein the first antenna is a monopole antenna characterized generally by a C-shape having two substantially parallel legs, and wherein the second antenna is a monopole antenna characterized generally by an L-shape having a longer leg and a shorter leg, and wherein the third antenna is a monopole antenna characterized by a meander shape.

23. The device of claim 22, wherein at least a portion of the longer leg of the L-shape of the second antenna lies below a plane created by an upper parallel leg of the C-shape of the first antenna.

24. The device of claim 23, wherein the two parallel legs of the C-shape of the first antenna are disposed on opposite surfaces of the carrier, and wherein the portion of the longer leg of the L-shape of the second antenna is disposed on a side of the carrier between the opposite surfaces.

25. The device of claim 14, wherein the fourth and fifth antennas are planar inverted F antennas (PIFAs); and wherein a first section of the fourth antenna extends perpendicularly from a feed trace, and a second section of the fourth antenna connects to an end of the first section of the fourth antenna opposite the feed trace and extends parallel to the feed trace in a direction opposite to a feed point of the feed trace; and wherein a first section of the fifth antenna connects to the feed trace at a point farther from the feed point than the point where the first section of the fourth antenna connects to the feed trace, and the first portion of the fifth antenna extends perpendicularly from the feed trace toward the second section of the fourth antenna to a point short of the second section of the fourth antenna, and a second section of the fifth antenna connects to an end of the first section of the fifth antenna opposite the feed trace and extends parallel to the feed trace in a direction opposite the feed point, and a third section of the fifth antenna connects to an end of the second section of the fifth antenna and extends parallel to the first section of the fifth antenna parallel in a direction toward the feed trace.

26. The device of claim 25, wherein a ground trace connects to the feed trace on a side of the feed trace opposite the side where the fourth and fifth antennas connect to the feed trace, and wherein the ground trace has a shape such that the ground trace and the feed trace outline an L-shaped gap, with the feed trace forming the longest side of the L-shaped gap.

27. A wireless communication device comprising:

an antenna carrier, wherein the antenna carrier is a ceramic material characterized by a permittivity of at least about 6;

a first antenna array disposed on the antenna carrier, wherein the first antenna array includes a first antenna adapted for about 2.4 gigahertz (GHz) wireless communication, a second antenna adapted for about 5 GHz wireless communication, and a third antenna adapted for wireless communication for a global positioning system; and a second antenna array disposed on the antenna carrier in a different region than the first antenna array, the second antenna array comprising at least one of a fourth antenna adapted for about 850 megahertz (MHz) wireless communication or a fifth antenna adapted for about 1800/1900 MHz wireless communication.

28. The device of claim 27, wherein the first antenna array further includes a feed trace coupled to the first antenna, the second antenna, and the third antenna.

29. The device of claim 27, wherein the first antenna is adapted for a wireless communication system selected from the group consisting of a wireless local area network system, a wireless metropolitan area network system, and a wireless short-range communication system.

30. The device of claim 29, wherein the wireless metropolitan area network system is a WiMax communication system.

31. The device of claim 29, wherein the wireless short-range communication system is a Bluetooth communication system.

32. The device of claim 27, wherein the second antenna is adapted for wireless communication for a wireless local area network.

33. The device of claim 27, wherein the first antenna is a monopole antenna characterized generally by a C-shape having two substantially parallel legs, and wherein the second antenna is a monopole antenna characterized generally by an L-shape having a longer leg and a shorter leg, and wherein the third antenna is a monopole antenna characterized by a meander shape.

34. The device of claim 33, wherein at least a portion of the longer leg of the L-shape of the second antenna lies below a plane created by an upper parallel leg of the C-shape of the first antenna.

35. The device of claim 34, wherein the two parallel legs of the C-shape of the first antenna are disposed on opposite surfaces of the carrier, and wherein the portion of the longer leg of the L-shape of the second antenna is disposed on a side of the carrier between the opposite surfaces.

* * * * *